United States Patent [19]

Ronen et al.

[11] Patent Number: 5,042,175

[45] Date of Patent: Aug. 27, 1991

[54] USER-SPECIFIC SHOE SOLE COIL SPRING SYSTEM AND METHOD

[76] Inventors: Samuel Ronen, 2a Golomb St., Herzliya; Shoshana Talmor, 43 Bar-Ilan St., Raanana, both of Israel

[21] Appl. No.: 472,268

[22] Filed: Jan. 30, 1990

[51] Int. Cl.[5] ..... A43B 13/18

[52] U.S. Cl. ..... 36/28; 36/27; 36/15; 36/43

[58] Field of Search ..... 36/7.8, 27, 15, 103, 36/24, 28, 132, 43

[56] References Cited

U.S. PATENT DOCUMENTS

| | | | |
|---|---|---|---|
| 3,351,353 | 11/1967 | Weitzner | 280/7.13 |
| 4,377,042 | 3/1983 | Bauer | 36/101 |
| 4,715,130 | 12/1987 | Scatena | 36/27 |
| 4,805,319 | 2/1989 | Tonkel | 36/28 |
| 4,887,367 | 12/1989 | Mackness et al. | 36/28 |

*Primary Examiner*—Jimmy G. Foster

*Assistant Examiner*—Thomas P. Hilliard

*Attorney, Agent, or Firm*—Edward Langer

[57] ABSTRACT

A user-specific shoe sole coil spring system provided as a customized layout of individual coil springs which are seated in a shoe sole having prefabricated circular depressions on its surface. The coil spring system layout and stiffness characteristics may be customized to serve the needs of different users and different applications. A user's weight and particular comfort and/or orthopedic requirements are met in a given shoe size by fitting it with a greater or lesser quantity of springs with different levels of stiffness, or the layout may be a combination of levels. The result is a shock absorption distribution pattern and energy return system for the shoe sole to suit the requirements of a particular application. The sole has a cover strip overlaying the coil spring system which is openable and reclosable for allowing changes in the layout as required, or an entire sole may be replaced as a unit.

17 Claims, 4 Drawing Sheets

USER-SPECIFIC SHOE SOLE COIL SPRING SYSTEM AND METHOD

FIELD OF THE INVENTION

The present invention relates to shoe construction, and more particularly to a novel coil spring system for a shoe featuring a user-specific, customized layout for various areas of the shoe sole, applicable to athletic, working and walking shoes, or to other activities associated with a particular group.

BACKGROUND OF THE INVENTION

The prior art includes various shoe constructions in which a spring is applied to a shoe sole for shock absorption, and energy return during walking or running. Examples of these designs include that shown in U.S. Pat. No. 4,843,737 to Vorderer, in which two outwardly curved plates having a tensioning spring are placed in the heel of an athletic shoe, to store and return energy to a runner while providing shock absorption. U.S. Pat. No. 4,815,221 to Diaz discloses a shoe sole having an energy control system located in a cavity of the sole, which comprises a set of spring strips and an overlying energy absorbing member capable of absorbing impact energy.

In U.S. Pat. No. 4,774,774 to Allen, a shoe sole structure is disclosed comprising a plurality of vertically stacked disc-springs spanning the width and length of the sole to form a honeycomb framework which applies energy to the base of the foot upon release after load compression. A spring boot for bouncing and exercise is disclosed in U.S. Pat. No. 4,660,299 to Omilusik, wherein a set of four coil springs is attached to the underside of a boot.

U.S. Pat. No. 4,506,460 to Rudy describes a spring-type moderator in combination with an air-cushioned sole in an athletic shoe providing improved shock absorption and energy return. A hopping and dancing shoe is described in U.S. Pat. No. 4,457,084 to Horibata, et. al., comprising a shoe sole and two coil springs attached on its underside by bolts and nuts. In a similar design, U.S. Pat. No. 4,196,903 to Illustrato discloses a pair of jog-springs attached to the underside of a shoe sole providing a soft, bouncing action in use. In U.S. Pat. No. 3,777,374 to Hendricks, a pleasure shoe is disclosed having a compression spring unit fitted into a shoe heel for providing shock absorption.

A shoe having a sole element provided with bores for retaining resilient means such as spring elements is disclosed in U.S. Pat. No. 2,710,460 to Stasinos. In U.S. Pat. No. 2,437,227 to Hall, a cushioned shoe sole is disclosed comprising a cushioning layer composed of resilient material with coil springs molded therein, and placed between top and bottom facing sheets.

As is well known, the feet, and particularly the soles of the feet, carry the entire body weight. The many shoe sole constructions found in the market absorb only a small portion of the shock caused as the shoe contacts the floor, and shocks which are not absorbed cause damage to the body. This occurs in the soles of the feet, which have many bones and many jointed surfaces, and in the knees which have fine miniscus stabilizing the joints and permitting smooth movement. The spinal cord is built from many vertebrae, with discs between them which are very sensitive to changes, and which permit bending and straightening of the body.

Over a long period of walking, the beating and shocks imparted to the soles of the feet may cause stress fractures in the legs. Also, these shocks cause changes in the structure of the vertebrae, affecting the discs between them, by making them thin and irregular due to friction, so that they lose their flexibility. This damage causes limited movement and flexibility for the entire length of the spinal cord, leading to neck and shouder pain, poor blood circulation, and stability problems.

The effects of the damage to the discs are felt frequently in back pain, along with a tendency for increased fatigue, and over time the growth of bone fibers is expected in the area around the vertebrae. Sometimes this brings about a split in the disc as it explodes under pressure to its soft center. Damage to the discs of the vertebrae can also cause distortion in straightness of the back which brings about pressure on nerves and may cause a neurological block leading to paralysis. In addition, problems including headaches, dizziness and deadening of the senses cause major day-to-day discomforts.

In order to solve these and other related problems, and to address the needs of individual users whose requirements vary, there is a need to provide an improved system of shock absorption which is user-specific and preserves the maximum amount of energy accumulating during compression of the material from which the sole is constructed, reducing wastage by friction or heat, enabling maximum energy to be returned after compression.

SUMMARY OF THE INVENTION

Accordingly, it is a principal object of the present invention to overcome the above-mentioned disadvantages of prior art shoe constructions and provide a user-specific coil spring system for a shoe sole featuring a customized layout covering various areas of the sole in accordance with user requirements.

In accordance with a preferred embodiment of the invention, there is provided a coil spring system for absorbing shocks and returning energy in a shoe sole, said system comprising:

a flexible sole having formed on an upper side thereof, a plurality of recesses;

a plurality of coil springs arranged in a layout over the area of said flexible sole, each of said coil springs being seated within one of said recesses; and a cover strip overlaying said flexible sole and said coil springs to form a sealed unit, said coil spring layout providing shock absorption and energy return upon compression in accordance with a predetermined distribution pattern in relation to a stiffness characteristic associated with each of said coil springs.

In the preferred embodiment, the shoe sole coil spring system is a customized layout of individual coil springs which are seated in a shoe sole cushion having prefabricated circular depressions on its surface. The coil spring system layout and stiffness characteristics may be customized to serve the needs of different users and different applications. For example, depending on the weight of the user, a given shoe size may be fitted with a greater or lesser quantity of springs with different levels of stiffness, or the layout may be a combination of levels. The result is a shock absorption distribution pattern and energy return system for the shoe sole cushion to suit the requirements of the particular application.

By virtue of its customized layout, the inventive shoe sole cushion design enables various problems to be addressed, including posture and balance, weakness and paralysis in the lower extremities, distortion in the vertebrae, hunchback, lordosis fallen arches, etc. Stress fractures in the legs can be reduced.

The customized layout may be implemented originally during shoe assembly, or it may be achieved by opening the shoe sole cushion and establishing a particular coil spring system layout at the point of sale. The second approach is made possible by a novel shoe sole cushion construction which permits opening and reclosing of the sole cushion for purposes of changing the spring system layout.

Variations in the shoe sole cushion construction enable it to be used in several ways, such as by attachment under the shoe base, inserted via a slot formed in the base, or as a shoe pad.

This permits the development of various customized spring layouts in accordance with a prescription from an orthopedic specialist. Using the prescription, a shoe salesman at a local store can implement the spring system layout, and if the user feels the need for adjustments, these can be made at the same time. Thus, maximum comfort is also achieved in the layout.

Another feature of the invention is the provision of rounded tip or flat plugs for placement into the coil springs at their upper ends to give a textured or smooth finish to the shoe sole cushion. The rounded tip plugs are useful in enabling the practice of non-conventional medical technologies, such as reflexology, in specific cases, to stimulate the soles of the feet.

Other features and advantages of the invention will become apparent from the drawings and the description contained hereinbelow.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1:
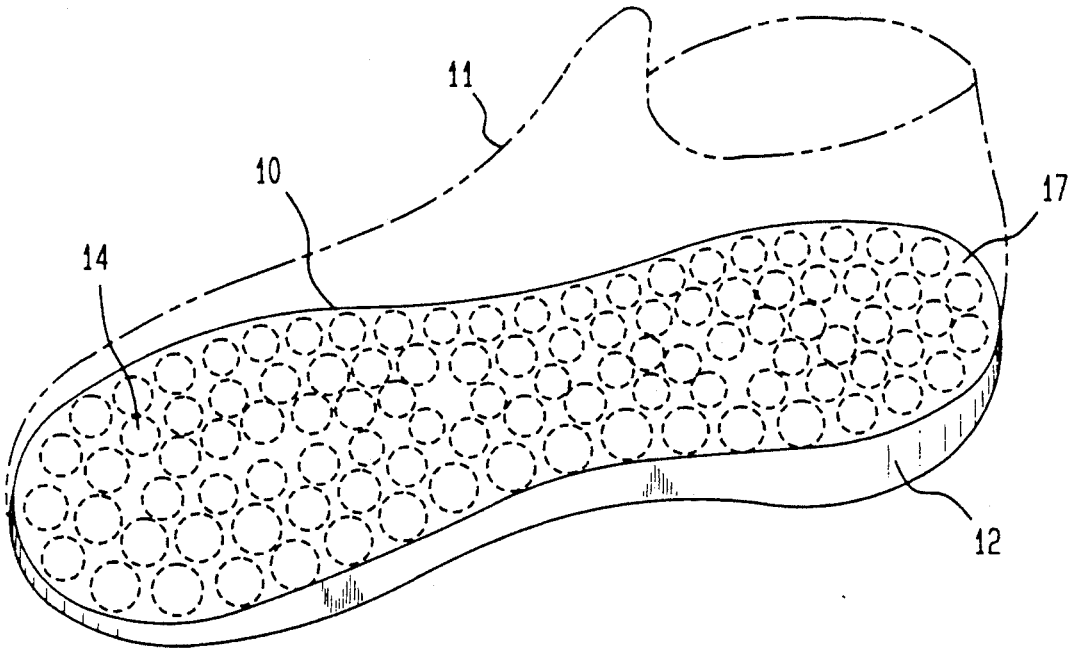
FIG. 1 is a perspective view of a preferred embodiment of a shoe sole coil spring system layout constructed in accordance with the principles of the present invention.

Referring now to FIG. 1, there is shown a preferred embodiment of a shoe sole coil spring system 10 constructed in accordance with the principles of the present invention. Shoe 11 has a sole cushion 12 which is typically made of a flexible material, such as rubber, and is provided with a set of circular depressions or recesses 14 over its length and width. Each of recesses 14 may be filled with a suitably shaped filler material such as a rubber disc, which can be removed by prying loose from a given recess 14. In accordance with the invention, a set of coil springs 16 (FIG. 2) is provided for placement in recesses 14, and a customized layout of coil springs 16 may be developed by use of appropriate ones of recesses 14.

A cover layer 17 is attached at the upper edges of sole cushion 12 to enclose the coil spring system 10. In use, as body weight is applied via the foot to sole cushion 12, the user benefits from a shock absorption distribution pattern and energy return system provided in accordance with the customized coil spring system 10 layout. For example, based on the fact that the entire body weight is supported by the rear portion of foot, that is, the calcaneus, coil spring system 10 may use springs having a higher stiffness in this area, i.e. a greater spring constant, to aid a user in maintaining proper posture. This may be accomplished by providing the springs in this area with approximately 25% greater stiffness than those in the remaining areas of sole cushion 12.

Figure 2:
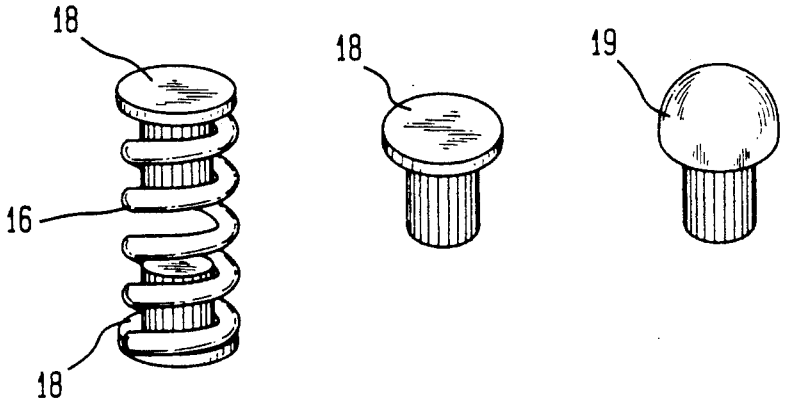
FIG. 2 shows a typical coil spring arrangement for use in the coil spring layout of FIG. 1.

In FIG. 2, a typical coil spring arrangement is shown, in which a plug 18, typically made of plastic, is provided for seating within coil spring 16 itself at either end. The lengths of plugs 18 are designed such that their opposite ends do not contact one another when spring 16 is compressed. Plug 18 has a flat head, while another plug 19 type has a rounded tip. Each of plugs 18, 19 is shaped with a shoulder against which an end of spring 16 rests. As described further herein, while the flat head of plug 18 is normally used in system 10, rounded tip plug 19 may be used for specific requirements relating to foot stimulation.

The inventive coil spring system 10 layout may be adapted for many applications, including walking, dancing, running or jumping in sports applications, for use in hiking shoes, in weight-bearing work shoes, or for use in a reflexology technique to apply pressure points for foot stimulation in specific areas. Each of these applications requires a particular solution since each creates different pressures on different areas of the foot, or no pressure at all. These differences must be expressed in relation to the body weight, that is, in order to provide a comfortable solution to different users, even though they may have the same size foot.

Thus, for a body weight of between 60–80 kg, the springs 16 used may have a spring constant K, and for body weight of 80–100 kg, a spring constant K1 may be used, while for a body weight of 100–120 kg, a spring constant K2 may be used, wherein the spring constants follow the relation: $K<K1<K2$.

As stated above, different applications require different solutions which minimize the damaging effects of shocks to the feet. For example, while dancing, the feet experience shocks which are greater than those produced by walking, and much pressure is exerted on the toes. Thus, the stiffness of the springs placed in these areas should be higher, in order to minimize shocks to the body.

In another application such as sports, where jumping and running are the main activities, especially high shocks are imparted to the feet. In order to minimize these shocks, and to utilize the energy absorbed by the coil spring system 10 with maximum efficiency, the spring constant of coil springs 16 in the area of the calcaneus and the metatarsus must be increased accordingly. The energy return function of springs 16 literally "pushes" the foot upwards after compression.

Figure 3:
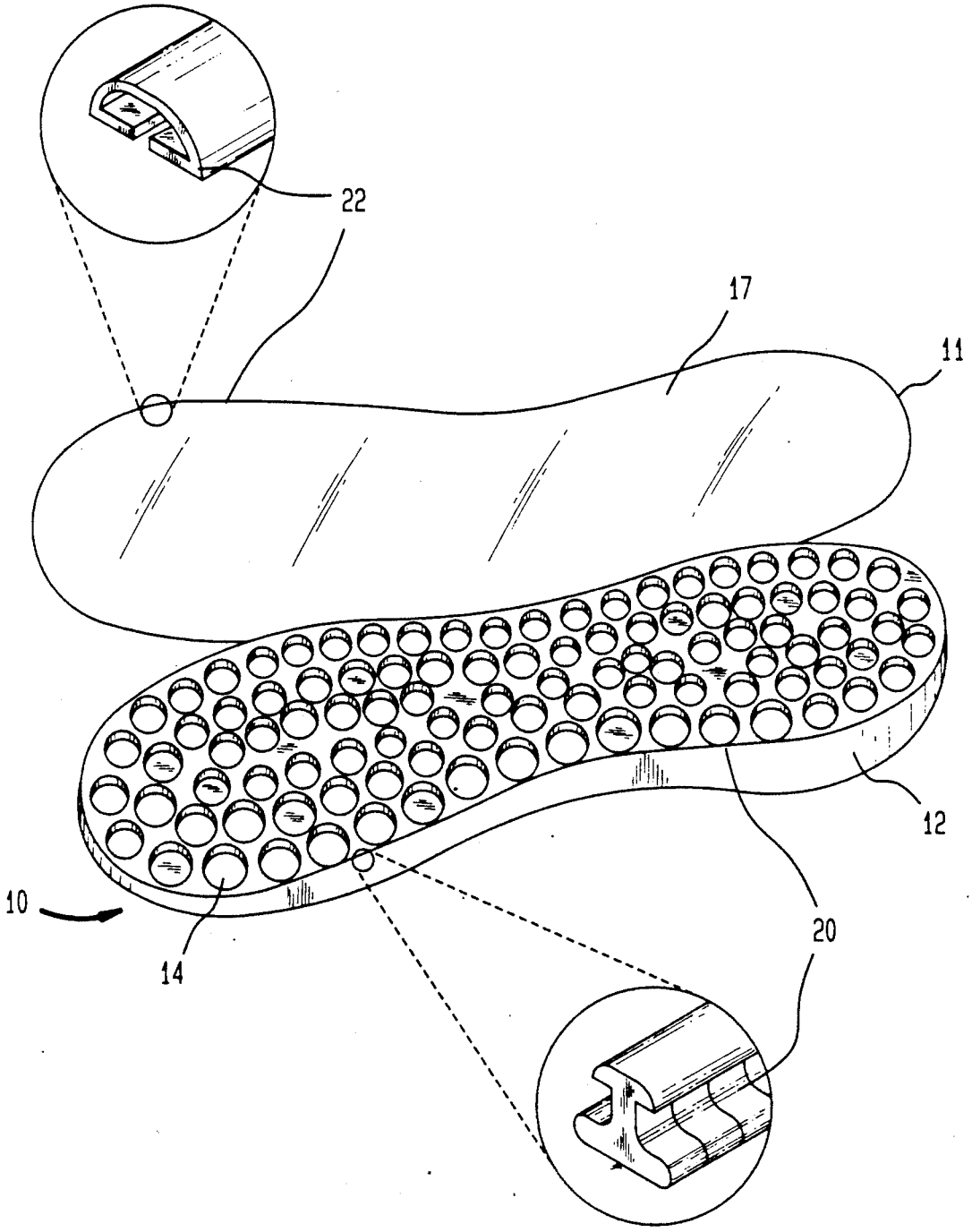
FIG. 3 is a perspective view of an alternative embodiment of the coil spring system layout of FIG. 1, featuring a reclosable sole cushion construction attachable to the shoe base.

Referring now to FIG. 3, there is shown a perspective view of an alternative embodiment of the coil spring system 10 layout of FIG. 1, featuring a reclosable sole construction enabling layout changes. In this embodiment, shoe sole cushion 12 is provided with a contoured rib 20 integrally formed therewith and extending around its circumference, which is fabricated of the same flexible material as sole cushion 12. Cover layer 17 is provided as the bottom surface of the upper portion of shoe 11, and has formed about its circumference a groove 22 shaped so as to engage contoured rib 20 when pressed therein, enabling coil spring system 10 to be closed by attaching cover layer 17 to sole cushion 12.

By prying contoured rib 20 out of groove 22, shoe sole cushion 12 may be opened, so that the customized layout of coil spring system 10 may be changed. As a result of this novel construction technique, the shock distribution pattern and energy return system provided by shoe sole cushion 12 may be adjusted at the point of sale to suit the above-described user applications. That is, by opening of shoe sole cushion 12 and addition or removal of coil springs 16 or variation in their layout, the requirements of different applications can be addressed. Reclosing sole cushion 12 is easily achieved by pressing contoured rib 20 into groove 22 of shoe 11.

Figure 4:
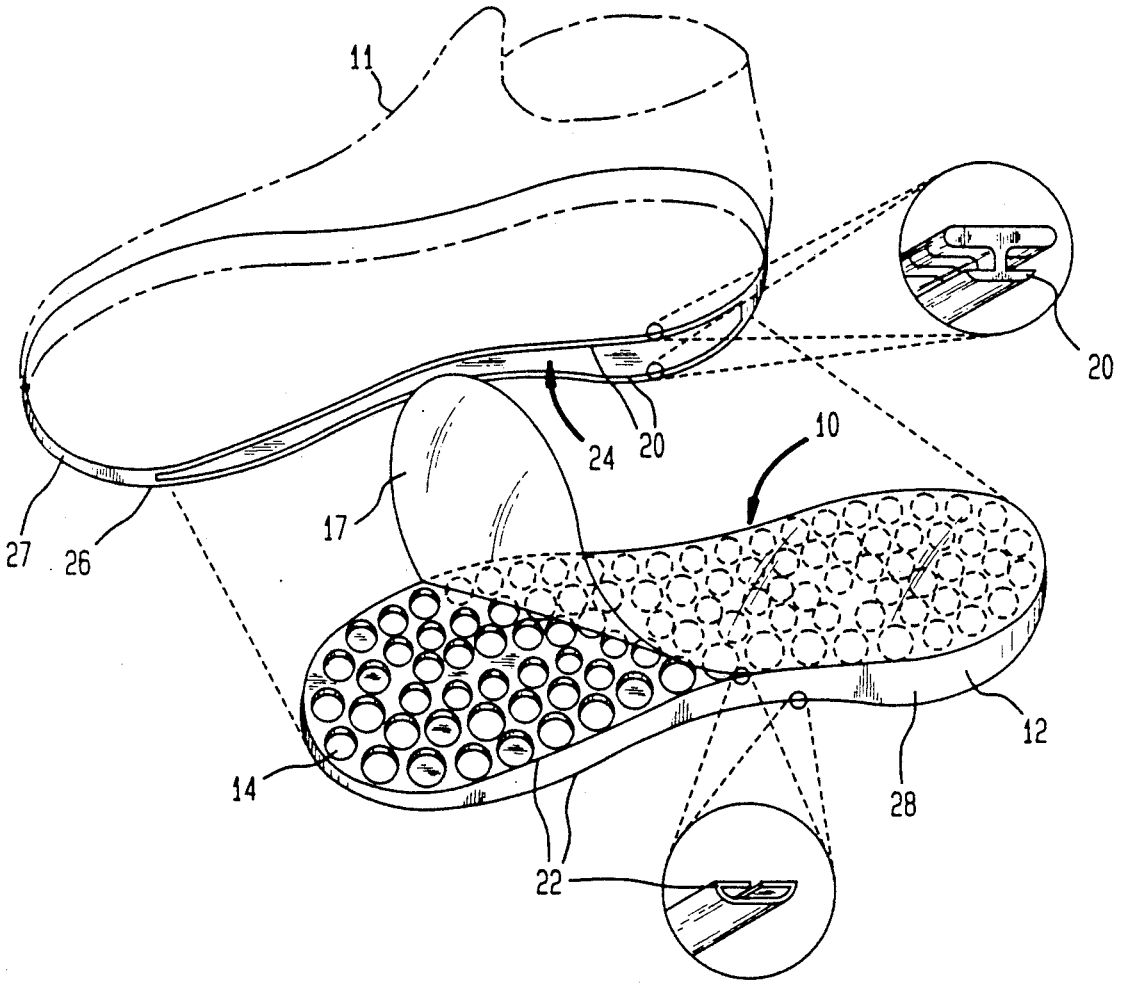
FIG. 4 is a perspective view of another alternative embodiment of the coil spring system layout, showing a reclosable sole cushion construction insertable via a slot in the shoe base.

In FIG. 4, another alternative embodiment of the coil spring system 10 layout of FIGS. 1 and 3 is shown in perspective, featuring a reclosable sole cushion construction which is removable from shoe 11 for making layout changes. In this arrangement, sole cushion 12 is fitted within a hollow base compartment 24 of shoe 11, via a slotted opening 26 in shoe wall 27. A pair of contoured ribs 20 and grooves 22 are provided respectively on the outer edge 28 of sole cushion 12, and on the upper and lower edges of slotted opening 26. Once cover layer 17 is placed over sole cushion 12 and it is fitted within base compartment 24, ribs 20 and grooves 22 can be used to lock sole 12 in position.

A particular advantage of this embodiment is the possibility of having a plurality of pre-designed customized layouts of coil spring system 10 in individual sole cushions 12, each available for immediate use in a particular group of applications. Thus, a user could purchase a shoe and specify a particular application, i.e., walking, sports, or dancing, which is then matched with a pre-designed customized layout. The appropriate shoe sole cushion 12 is then selected and inserted into base compartment 24 of shoe 11, wherein it is locked in position. If adjustments are needed, the shoe sole cushion 12 can be removed through slotted opening 26, and cover layer 17 may be opened for making changes in the layout.

Another possible approach is the provision of a prescription from an orthopedist or podiatrist which specifies the areas of the sole cushion 12 which are to be treated by the beneficial effects of the customized layout, including the necessary spring characteristics, etc. The user could present the prescription to the vendor of the inventive shoe sole cushion 12 design, who could then implement the appropriate customized layout.

Figure 5:
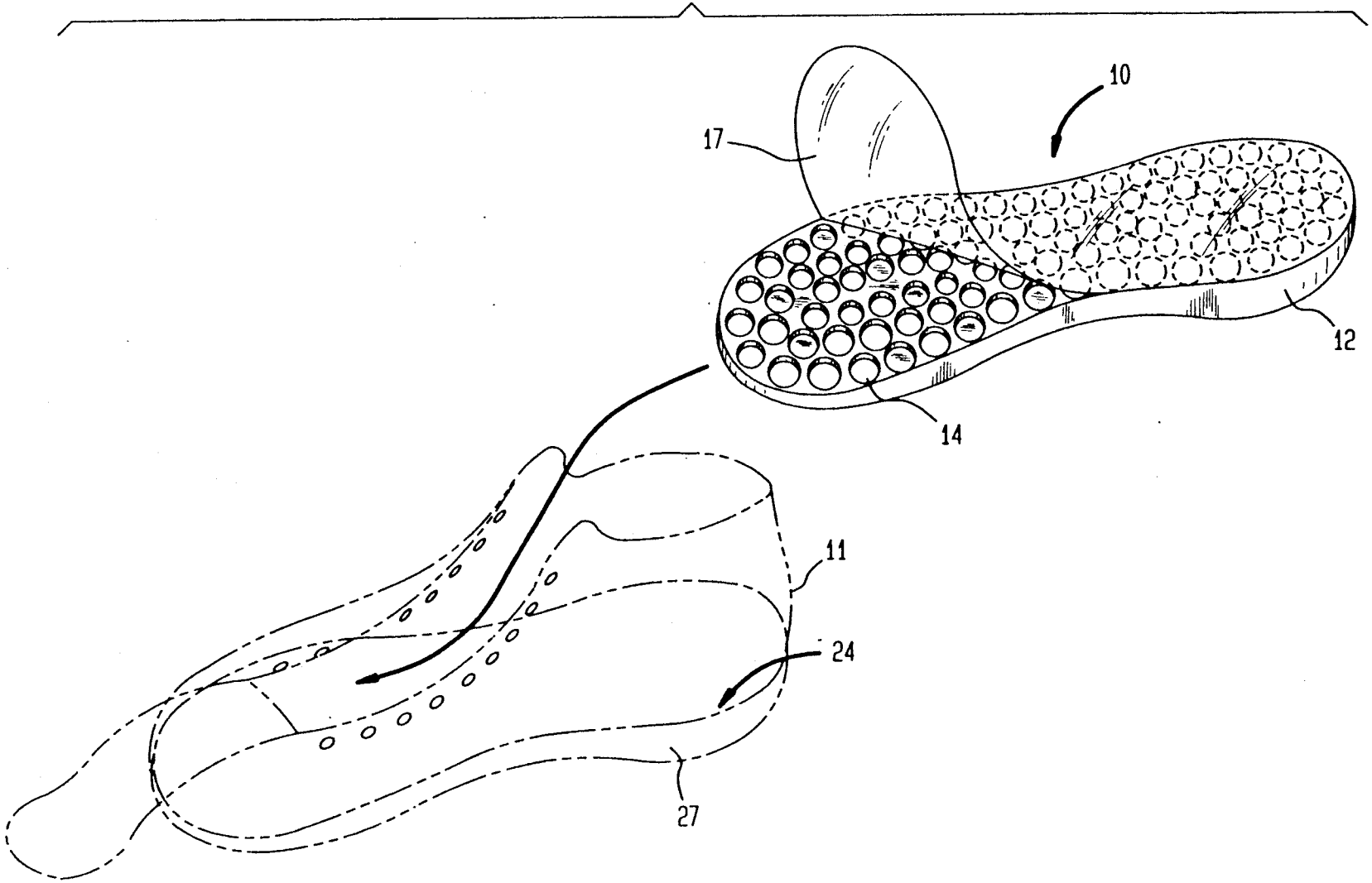
FIG. 5 is a perspective view of still another embodiment of the coil spring system layout, showing a removable shoe pad insertable via the shoe opening.

In FIG. 5, still another alternative embodiment is shown, in which sole cushion 12 is arranged as a shoe pad design, which can be removably inserted in shoe 11. In this arrangement, shoe 11 is manufactured with a sealed bottom surface such as rubber, but without a sole cushion 12, and hollow base compartment 24 is adapted to allow push-fit insertion of sole cushion 12 therein. Shoe 11 then completely encloses sole cushion 12 without need for further closure means, and shoe walls 27 maintain it fixed in position. A contoured pull strap (not shown) may be attached at the end of sole 12, and tucked against the shoe heel wall, for easy removal.

A particular advantage of this approach is that as the shoe pad design of sole cushion 12 is worn, it adjusts itself to the contour of the foot, becoming more comfortable. This comfort may be transferred by removing sole cushion 12 from one shoe 11, and inserting it in a new shoe body which replaces a worn-out one. This achieves a cost savings as well, since only a new shoe body must be purchased, and a used sole cushion 12 can be inserted therein.

Alternatively, a user may choose to purchase several different sole cushions 12 for each of shoes 11, so that different customized layouts of coil spring system 10 may be applied in accordance with different intended applications, as described.

In summary, by virtue of its customized layout, the inventive coil spring system and shoe sole design minimizes various shock abosorption problems of the feet and legs, including those leading to stress fractures and other damage related to specific user applications.

Having described the invention with regard to certain specific embodiments thereof, it is to be understood that the description is not meant as a limitation since further modifications may now suggest themselves to those skilled in the art, and it is intended to cover such modifications as fall within the scope of the appended claims.

We claim:

1. A two-part shoe construction providing a coil spring system for absorbing shocks and returning energy in a shoe sole, said system comprising:

a shoe body having a sealed bottom surface and a hollow base compartment;

a flexible sole cushion having formed on a upper side thereof, a plurality of recesses;

a plurality of coil springs arranged in a layout over the area of said flexible sole cushion, each of said coil springs being seated within one of said recesses; and a cover strip overlaying said flexible sole cushion and said coil springs to form a sealed unit, said coil spring layout providing shock absorption and energy return upon compression in accordance with a predetermined distribution pattern in relation to a stiffness characteristic associated with each of said coil springs, said sealed unit being removably insertable into said hollow base compartment via an opening in said shoe body, enabling replacement of said sealed unit with another and allowing variation of said coil spring layout and said predetermined distribution pattern.

2. The system of claim 1 wherein said plurality of coil springs have varying stiffness characteristics each in relation to its associated spring constant.

3. The system of claim 1 wherein said cover strip is attached to said flexible sole cushion in separable fashion so as to allow access to said coil spring layout for making changes therein in accordance with user-specific requirements.

4. The system of claim 3 wherein said cover strip is provided with a rib extending around its circumference and said flexible sole cushion is provided with a groove formed in its outer circumference, said rib being removably insertable into said groove for attaching said cover strip to said flexible sole cushion.

5. The system of claim 1 wherein said sealed unit is removably insertable into said hollow base compartment via a slotted opening in said shoe body.

6. The system of claim 5 wherein said sealed unit has formed on an outer edge thereof a set of grooves into which ribs provided on said slotted opening are insertable, for locking said sealed unit into position.

7. The system of claim 1 wherein each of said coil springs has mounted therein at an end thereof a substantially cylindrical plug formed with a shoulder upon which said coil spring end rests.

8. The system of claim 7 wherein said plug has a flat head.

9. The system of claim 7 wherein said plug has a rounded tip for providing stimulation of a particular area of the foot.

10. A method of assembling a two-part shoe construction to enable customizing a coil spring system layout designed to absorb shocks and return energy in a shoe sole in accordance with user-specific requirements, said method comprising the steps of:

removing a shoe sole cushion from a shoe body having a sealed bottom surface and a hollow base compartment;

separating from the shoe sole cushion a cover layer overlaying and enclosing the coil spring system in the shoe sole cushion;

adjusting at least one of the layout and stiffness of coil springs in the opened shoe sole cushion, so as to customize it;

replacing said cover layer on said customized shoe sole cushion; and replacing said customized shoe sole cushion in said shoe body.

11. The method of claim 10 wherein said shoe sole cushion removal and replacement steps are performed by opening a slot formed in said base compartment of said shoe body, and sliding said shoe sole cushion therethrough.

12. The method of claim 10 wherein said shoe sole cushion removal and replacement steps are performed by respectively pulling and pushing said shoe sole cushion through the top opening in said shoe body.

13. The method of claim 10 wherein said cover layer separating step is performed by prying a rib formed on the circumferential edge of said shoe sole cushion from a groove formed in the circumference of said cover layer.

14. The method of claim 10 wherein said cover layer replacing step is performed by pressing a rib formed on the circumferential edge of said shoe sole cushion into a groove formed in the circumference of said cover layer.

15. A two-part shoe construction providing a coil spring system for absorbing shocks and returning energy in a shoe sole, said system comprising:

a shoe body having a sealed bottom surface and a hollow base compartment;

a flexible sole cushion having formed on an upper side thereof, a plurality of recesses;

a plurality of coil springs arranged in a layout over the area of said flexible sole cushion, each of said coil springs being seated within one of said recesses; and a cover strip overlaying said flexible sole cushion and said coil springs to form a sealed unit, a circumferential rib of said cover strip being provided with a rib extending around its circumference which is removably insertable into a groove formed in the circumference of said flexible sole cushion for attaching said cover strip to said flexible sole cushion, thereby allowing access to said coil spring layout for making changes therein in accordance with user-specific requirements, said coil spring layout providing shock absorption and energy return upon compression in accordance with a predetermined distribution pattern in relation to a stiffness characteristic associated with each of said coil springs, said sealed unit being removably insertable into said hollow base compartment via an opening in said shoe body, enabling replacement of said sealed unit with another and allowing variation of said coil spring layout and said predetermined distribution pattern.

16. The system of claim 15 wherein said sealed unit is removably insertable into said hollow base compartment via a slotted opening in said shoe body.

17. The system of claim 15 wherein said sealed unit is removably insertable into said hollow base compartment via the top opening of said shoe body.

* * * * *